US009248845B2

(12) United States Patent
Starbatty

(10) Patent No.: US 9,248,845 B2
(45) Date of Patent: Feb. 2, 2016

(54) TORQUE SUPPORT AND A BOGIE FOR A RAIL VEHICLE

(71) Applicant: Voith Patent GmbH, Heidenheim (DE)

(72) Inventor: Frank Starbatty, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 66 days.

(21) Appl. No.: 14/052,220

(22) Filed: Oct. 11, 2013

(65) Prior Publication Data

US 2014/0033947 A1 Feb. 6, 2014

Related U.S. Application Data

(63) Continuation of application No. PCT/EP2012/001479, filed on Apr. 3, 2012.

(30) Foreign Application Priority Data

Apr. 13, 2011 (DE) ..... 10 2011 016 906

(51) Int. Cl.
*B61C 9/48* (2006.01)
*B61C 9/50* (2006.01)

(52) U.S. Cl.
CPC ..... *B61C 9/50* (2013.01)

(58) Field of Classification Search
CPC ..... B61F 3/00; B61F 3/02; B61F 3/04; B61C 9/00; B61C 9/02; B61C 9/04; B61C 9/38; B61C 9/48; B61C 9/50
USPC ..... 105/133, 136, 138, 139
See application file for complete search history.

(56) References Cited

U.S. PATENT DOCUMENTS

| | | | | |
|---|---|---|---|---|
| 4,262,929 | A * | 4/1981 | Pierce | 280/124.108 |
| 5,505,482 | A * | 4/1996 | VanDenberg | 280/86.5 |
| 5,915,503 | A * | 6/1999 | Enright | 188/67 |
| 2008/0018110 | A1 * | 1/2008 | Roth | B61D 43/00 290/3 |
| 2010/0192800 | A1 | 8/2010 | Holzapfel et al. | |

FOREIGN PATENT DOCUMENTS

CN 201619582 U 11/2010

OTHER PUBLICATIONS

International Search Report and Written Decision of the International Searching Authority dated Jul. 24, 2012 for International Application No. PCT/EP2012/001479 (12 pages).

(Continued)

*Primary Examiner* — R. J. McCarry, Jr.
(74) *Attorney, Agent, or Firm* — Taylor IP, P.C.

(57) ABSTRACT

A torque support for the articulated mutual support of two elements is provided, for example, a frame or a bogie on the one hand and a housing such as a final drive housing of a rail vehicle on the other hand. The torque support includes a rod, at the two ends of which one respective receiver head is arranged. The receiver head includes a bearing for accommodating a bolt which is used for support on the respective element. The rod is arranged as a sleeve at least in the region of its two ends and the bearing includes a socket which is arranged in the radial direction of the bolt between the bolt and the receiver head and is supported on the receiver head via at least one further bearing element. The socket includes a bulbous section in the manner of a universal ball joint on its outer circumference.

4 Claims, 2 Drawing Sheets

(56) References Cited

OTHER PUBLICATIONS

International Preliminary Report on Patentability dated Apr. 5, 2013 for International Application No. PCT/EP2012/001479 (9 pages).

Chinese Communication dated Jun. 19, 2015 for Chinese Application No. 201280017975.4 (5 pages).

* cited by examiner

TORQUE SUPPORT AND A BOGIE FOR A RAIL VEHICLE

CROSS REFERENCE TO RELATED APPLICATIONS

This is a continuation of PCT application No. PCT/EP2012/001479, entitled "TORQUE SUPPORT AND BOGIE FOR A RAIL VEHICLE", filed Apr. 3, 2012, which is incorporated herein by reference.

BACKGROUND OF THE INVENTION

1. Field of the Invention

The present invention relates to a torque support and a bogie, especially for a rail vehicle provided with a drive, e.g. for a locomotive.

2. Description of the Related Art

Such a bogie comprises a bogie frame. The frame supports one or several wheelsets. Each wheelset comprises wheels, a final drive with an axle and a final drive housing. At least one of the wheelsets is in drive connection with a drive motor of the rail vehicle. A transmission is usually arranged in this drive connection.

As a result, single-stage spur gears are usually used for the transmission of drive power from the drive motor to the wheels in metropolitan rail vehicles, i.e. in rail traffic with maximum operating speeds of 80 to 110 kilometers per hour (km/h). As a result of different maximum operating speeds which are usually between 80 km/h and 110 km/h and different motor concepts, the transmission ratios usually mostly vary between 6.3 and 7.7. This leads to the necessity that depending on the transmission ratio desired by the operator, which is chosen according to the intended maximum operating speed, a transmission needs to be chosen from a number of stored or offered transmissions of various sizes and to be installed in the rail vehicle. The producers of such railway vehicle transmissions therefore usually offer various transmissions of different sizes, in which the use of the same parts for the various transmissions sizes is extremely limited.

Torque supports are provided because such transmissions need to be supported against the driving torque of the drive motor concerning their installation position especially in the bogie of the rail vehicle. They allow an articulated support of the transmission on the bogie. The torque supports needs to bridge different distances depending on the size of the used transmission and the bogie and on the installation position. Consequently, a large number of different torque supports of different lengths and configurations need to be kept in stock. In the case of torque supports produced by primary forming, a separate tool is required for each embodiment. This increases the production and storage costs, both for new transmissions and also for the torque supports and spare parts. This is disadvantageous if, as a result of promises for warranty, the products of the various components need to be kept in stock over many years for a potentially necessary exchange. The increased variety is especially disadvantageous in the case of new developments, because in this case every single configuration needs to be adapted to the new technology. This consequently entails increased development costs.

What is needed in the art is a torque support and a bogie for a rail vehicle which avoids the disadvantages of the state of the art. In particular, a torque support should be provided which can be adapted easily to the different linkages of the final drive to the bogie and enable different lengths and angular installation positions. At the same time, the variety of components and the development and production costs should be reduced.

SUMMARY OF THE INVENTION

The present invention provides a torque support and a bogie for a rail vehicle, which overcomes the disadvantages of the state of the art. More specifically, the present invention provides a torque support for the articulated mutual support of two elements, for example a frame or a bogie on the one hand and a housing such as a final drive housing of a rail vehicle on the other hand. The inventive torque support includes a rod, at the two ends of which one respective receiver head is arranged. The receiver head includes a bearing for accommodating a bolt which is used for support on the respective element.

The rod is arranged in accordance with the present invention as a sleeve at least in the region of its two ends. The bearing includes a sleeve which is arranged in the radial direction of the bolt between the bolt and the receiver head and is supported via at least one further bearing element on the receiver head. The sleeve includes a bulbous section on its outer circumference in the manner of a spherical cap.

Different installation situations of the transmission relative to the bogie can be realized. Consequently, adjustments to the desired installation situation can occur by an adjustment of the length of the rod, in that it is accordingly cut to size depending on the embodiment and is then provided with receiver heads which are connected to the rod by friction welding for example. As a result, the same receiver heads can be used at all times for different embodiments without requiring a separate master pattern for each torque support. This helps reduce the variety of components for the torque supports to a considerable extent as well as the development costs, production costs and storage costs. The same applies to the associated final drives, which are usually connected in outgoing circuit to the transmission in the direction of power transmission as seen from the drive motor to the wheels.

A bogie in accordance with the present invention for a rail vehicle includes a bogie frame with at least one wheelset including two wheels, a final drive, an axle and a final drive housing. Furthermore, a torque support for the articulated mutual support of the final drive on the bogie or bogie frame is provided, wherein the torque support is arranged in accordance with the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
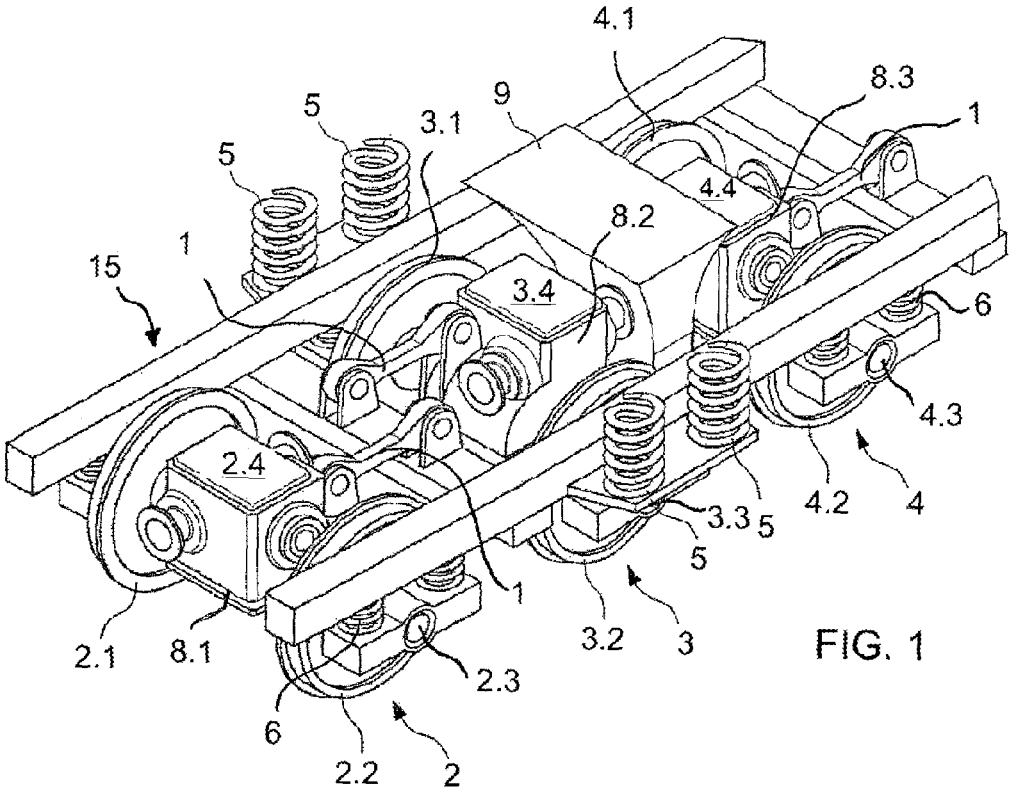
FIG. 1 shows a bogie with three wheelsets in a perspective view.

Referring now to the drawings, and more particularly to FIG. 1, there is shown a bogie for a locomotive. It includes three wheelsets 2, 3, 4. Each wheelset 2, 3, 4 includes two wheels 2.1, 2.2, 3.1, 3.2 and 4.1, 4.2, and further axles 2.3, 3.3 and 4.3, a final drive 2.4, 3.4, 4.4 and one respective final drive housing 8.1, 8.2, 8.3.

FIG. 1 further shows four springs 5. Springs 5 are disposed between the bogey and the frame of the locomotive (not shown), and further springs 6 which are disposed between bogie frame 15 and respective axle 2.3, 3.3 and 4.3. A link tower 9 is further shown in FIG. 1, positioned between final drives 3.4 and 4.4.

The illustrated components are accommodated by bogie frame 15. In the present case, final drive 2.4, 3.4, 4.4 is respectively supported in an articulated manner on bogie frame 15 by one respective torque support 1. Torque support 1 is used for absorbing the torque transmitted by the drive motor (not shown) via a transmission (also not shown) of the rail vehicle to respective final drive 2.4, 3.4, 4.4. The transmission could also be supported in an articulated manner on bogie frame 15 via the torque supports in accordance with the present invention.

Figure 2A:
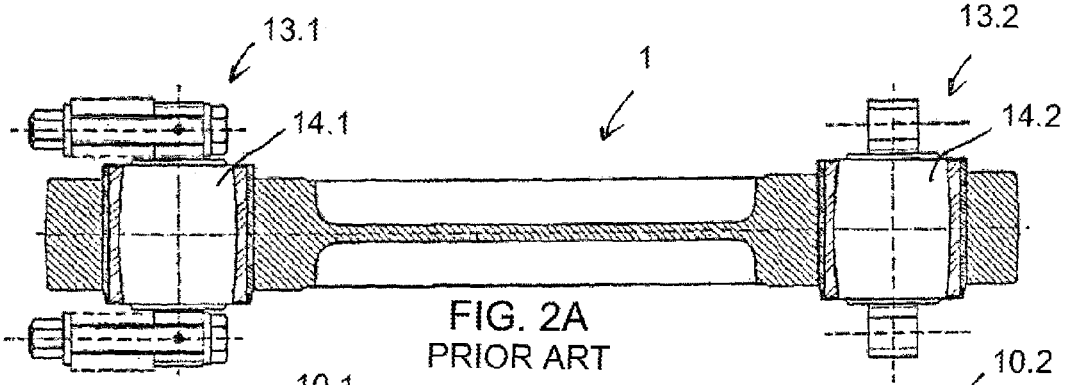
FIG. 2A PRIOR ART
FIG. 2A shows a torque support in a top view according to the state of the art.
Figure 2B:
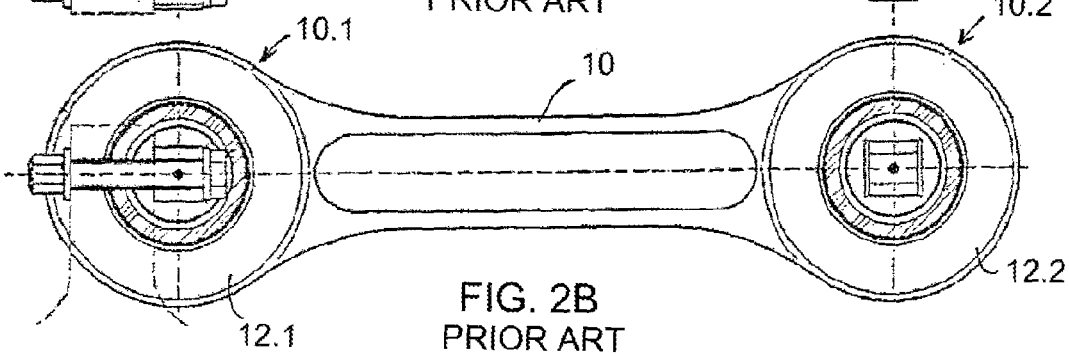
FIG. 2B PRIOR ART
FIG. 2B shows an axial sectional view of the torque support of FIG. 2A through its longitudinal axis according to the state of the art.

Referring now to FIG. 2, there is shown a torque support 1, as is known from the state of the art. It is produced by primary forming such as casting or forging and includes a rod 10 shaped in the manner of an open-end wrench, which integrally forms a receiver head 12.1, 12.2 at each of its ends 10.1, 10.2 in which a bearing 13.1, 13.2 is provided for accommodating one respective bolt 14.1, 14.2. Bolts 14.1, 14.2 are barrel-shaped in order to transmit optimal absorbing of transverse and bending torques from the transmission to the bogie. The barrel shape disadvantageously leads to higher production costs as a result of the production tolerances.

It is disadvantageous in these torque supports however that new torque supports are always required for different connection lengths, i.e. for different distances between two longitudinal axes of two bolts 14.1 and 14.2, and therefore a new casting or forging mold for the production of the same. This causes high development, production and storage costs when a large number of different embodiments of such torque supports need to be offered.

Figures 3A, 3B:
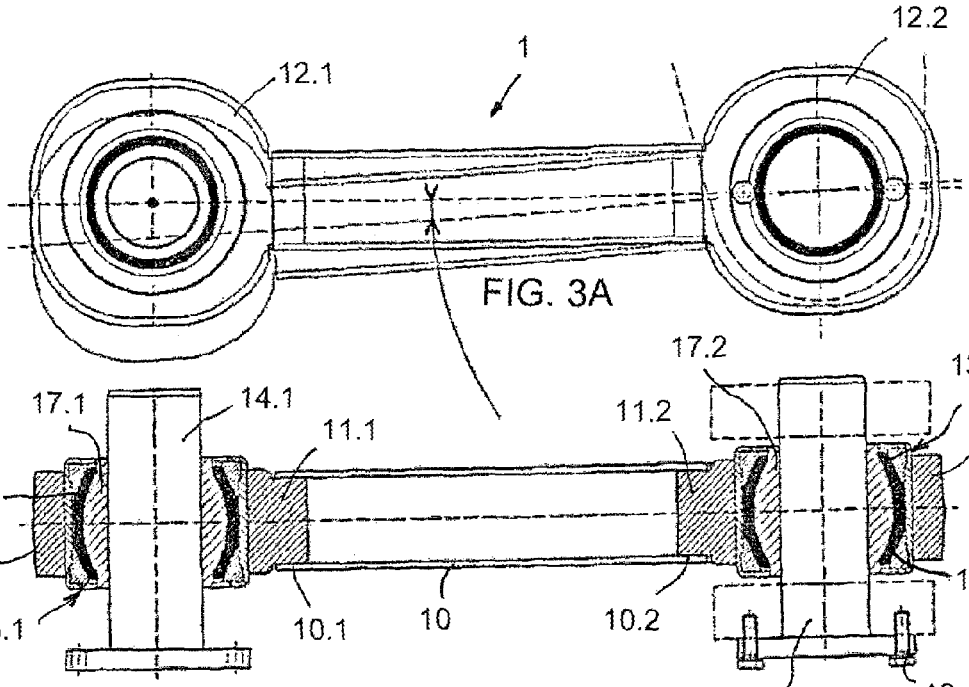
FIG. 3A shows a torque support in accordance with the present invention in a top view.
FIG. 3B shows a cross-sectional view through the longitudinal axis of the torque support of FIG. 3A.

Referring now to FIG. 3, there is shown a torque support 1 in accordance with the present invention. The same components are provided with the same reference numerals, as described above. Rod 10 of torque support 1 in accordance with the present invention is consistently arranged as a sleeve having an inner surface and an outer surface in the present case. The sleeve has a circular shape in this case, but other cross-sectional shapes can also be considered. It could also consist of a solid material and include respective sleeve-like bored portions only in the region of ends 10.1, 10.2.

In the present case, receiver heads 12.1, 12.2 respectively include a connection pin 11.1, 11.2, integrally formed into receiver heads 12.1, 12.2, wherein integrally formed connection pins 11.1, 11.2 have an outside shape which is complementary to the inner shape of rod 10 in the region of ends 10.1, 10.2. It can also be considered that integrally formed connection pins 11.1 and 11.2 are arranged in such a way that they are placed on rod 10. In this case integrally formed connection pins 11.1, 11.2 would be provided with an inner bored portion which substantially has the same inner diameter as the outer diameter of ends 10.1 and 10.2 of rod 10.

For the purpose of producing torque support 1 in accordance with the present invention, it is accordingly adjusted in its length depending on the required connection length of rod 10. Subsequently, integrally formed connection pins 11.1, 11.2 are inserted into the rod 10 or are placed thereon, so that the integrally formed connection pins 11.1, 11.2,directly contact the inner surface or outer surface of the sleeve, and are non-detachably connected to the inner surface or outer surface of the sleeve, and are non-detachably connected to the rod in a material-formed joint by friction welding for example. It is also possible to provide other joining methods, for example friction-locked or interlocking ones.

Bolts 14.1, 14.2 are arranged cylindrically in the present case. Other cross-sectional shapes and polygons can, however, be considered. Sockets 17.1, 17.2 are provided for allowing transverse and bending torques to be absorbed. They respectively include a bulge on their outside surface and surround bolts 14.1, 14.2 in the circumferential direction. Sockets 17.1, 17.2 are inserted into bearing 13.1, 13.2. Each socket 17.1, 17.2 is supported in bearing element 13.1, 13.2 by a further bearing element 18.1, 18.2 such as a rubber element via the bulge which has a substantially spherical outside shape. Similarly, further bearing elements can be considered for supporting the sockets 17.1, 17.2 on receiver head 12.1, 12.2. As a result of socket 17.1, 17.2 arranged in accordance with the present invention, cylindrical bolts can now be inserted, thus substantially further reducing the amount of production work. In addition, angular positions can be compensated by providing bolts 14.1, 14.2 which are smaller in their diameter and smaller sockets 17.1, 17.2 which are respectively smaller according to the inner diameter, in combination with substantially constant connection length of bolts 14.1, 14.2 with respect to each other (see dashed lines in the top view of FIG. 3). As a result, it is possible with torque supports of the same connection lengths and by using bolts 14.1, 14.2 with different diameters to already compensate small angular changes in the mounting of the torque supports, e.g. before the start-up of the rail vehicle, in different arrangements of transmissions and bogies without having to produce a new torque support. As a result, the same connection lengths can be used depending on the gear ratio for different transmission sizes desired by the operator.

It is a further advantage of cylindrical bolts 14.1, 14.2 that instead of screwed connections they can also be joined by a press fit with final drive housing 8.1, 8.2, 8.3 and/or with the bogie. For this purpose, bolts 14.1, 14.2 and the associated receivers for bolts 14.1, 14.2 can accordingly be provided with tolerances for press fit on the bogie or final drive housing 8.1, 8.2, 8.3. An additional screwed connection (screw 19) could then merely be used for protection against twisting. Generally, it is not necessary to fulfill such high demands placed on quality as is the case in screwed connections in the state of the art, so that the production costs can be reduced considerably. Protection against twisting would also be possible by an interlocking connection, wherein in this case bolts 14.1, 14.2 and the associated receivers would be arranged accordingly.

Since the arrangement of bolts 14.1, 14.2 is completely flexible, it is possible for example to provide different receiver heads 12.1, 12.2 for each torque support. As a result, the receiver head 12.1 on the transmission side could be arranged in such a way for example that it includes a bolt 14.1 of a different diameter than the bolt 14.2 associated with the receiver head 12.2 on the bogie side. At least one of the two bolts 14.1, 14.2 could be arranged cylindrically and the other in the shape of a barrel. This would require respectively arranged different receiver heads 12.1, 12.2. Similarly, ends 10.1, 10.2 of rod 10 and connection pins 11.1, 11.2 could be arranged in a respectively different way in one and the same torque support.

The torque supports in accordance with the present invention offer the advantage that they can already be pre-mounted by the producer or supplier of the final drives and/or bogies. As a result, they can already be fixed only with the end on the bogie side to the bogie when it is delivered. However, they could also only be connected to final drive housing 8.1, 8.2, 8.3 when it is delivered, or be connected after mounting of the former in the bogie with the two elements. In any case, an especially flexible mounting of the torque supports in accordance with the present invention is possible, thereby considerably reducing the production and mounting costs of such a torque support.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Torque support
2 Wheelset
2.1, 2.2 Wheel
2.3 Axle
2.4 Final drive
3 Wheelset
3.1, 3.2 Wheel
3.3 Axle
3.4 Final drive
4 Wheelset
4.1, 4.2 Wheel
4.3 Axle
4.4 Final drive
5 Springs
6 Frame
7.1, 7.2 Sockets
8.1, 8.2, 8.3 Final drive housing
9 Link tower
10 Rod
10.1, 10.2 Ends
11.1, 11.2 Connection pin
12.1, 12.2 Receiver head
13.1, 13.2 Bearing
14.1, 14.2 Bolt
15 Bogie frame
16 Axle
17.1, 17.2 Socket
18.1, 18.2 Bearing element
19 Screw

What is claimed is:

1. A bogie for a rail vehicle, the bogie comprising:
a bogie frame;
at least one wheel set including two wheels, a final drive, an axle and a final drive housing;
a torque support for mutual articulated support of said final drive on one of the bogie and said bogie frame, said torque support including:
a rod having two opposing ends, said rod being arranged as a sleeve having an inner surface and an outer surface at least in regions of each of said two opposing ends;
a receiver head connected to each of said two opposing ends of said rod, each said receiver head having a connection pin integrally formed therewith, said connection pin being non-detachably connected to one of said inner surface and said outer surface of said rod, each said receiver head including:
a cylindrical bolt for support on said final drive on one of the bogie and said bogie frame, said cylindrical bolt connected to at least one of said final drive housing and the bogie by a press fit;
a bearing including a socket arranged in a radial direction of said bolt between said bolt and said receiver head, said socket including a bulbous section formed as a universal ball joint on an outer circumference of said socket; and
at least one further bearing element, said socket being supported on said receiver head via said at least one further bearing element; and
an anti-twisting element for said cylindrical bolt.

2. The bogie according to claim 1, at least one of said integrally formed connection pins one of having an inner board portion placed over said outer surface of one of said ends of said rod and having an outside shape inserted into said inner surface of said rod in an end region of said rod.

3. The bogie according to claim 2, said connection pin having an external shape and said rod having a complementary cross-sectional shape at least in said region of said two opposing ends.

4. The bogie according to claim 1, said socket and said at least one bearing forming an integral rubber-metal element.

* * * * *